US010055910B2

(12) United States Patent
Kayano

(10) Patent No.: US 10,055,910 B2
(45) Date of Patent: Aug. 21, 2018

(54) VEHICLE INFORMATION RECORDING DEVICE, PROGRAM THEREFOR, VEHICLE INFORMATION RECORDING METHOD, AND NON-TRANSITORY COMPUTER-READABLE STORAGE MEDIUM

(71) Applicant: DENSO CORPORATION, Kariya, Aichi-pref. (JP)

(72) Inventor: Masayoshi Kayano, Kariya (JP)

(73) Assignee: DENSO CORPORATION, Kariya, Aichi-pref. (JP)

( * ) Notice: Subject to any disclaimer, the term of this patent is extended or adjusted under 35 U.S.C. 154(b) by 36 days.

(21) Appl. No.: 15/117,873

(22) PCT Filed: Feb. 3, 2015

(86) PCT No.: PCT/JP2015/000462
§ 371 (c)(1),
(2) Date: Aug. 10, 2016

(87) PCT Pub. No.: WO2015/122147
PCT Pub. Date: Aug. 20, 2015

(65) Prior Publication Data

US 2017/0011565 A1 Jan. 12, 2017

(30) Foreign Application Priority Data

Feb. 14, 2014 (JP) ..... 2014-026613

(51) Int. Cl.
*F02D 41/22* (2006.01)
*F02D 41/26* (2006.01)
(Continued)

(52) U.S. Cl.
CPC ..... *G07C 5/085* (2013.01); *F02D 41/22* (2013.01); *F02D 41/26* (2013.01);
(Continued)

(58) Field of Classification Search
CPC ..... F02D 41/065; F02D 41/22; F02D 41/26; F02N 11/0848; F02N 2250/06; G07C 5/085
See application file for complete search history.

(56) References Cited

U.S. PATENT DOCUMENTS 4,735,184 A * 4/1988 Kasanami ..... F02D 41/061 123/491
5,311,430 A 5/1994 Ishigami
(Continued)

FOREIGN PATENT DOCUMENTS

JP S61-292709 A 12/1986
JP 05104985 A * 4/1993 ..... G07C 5/085
(Continued)

*Primary Examiner* — Charles J Han
(74) *Attorney, Agent, or Firm* — Harness, Dickey & Pierce, P.L.C.

(57) ABSTRACT

A vehicle information recording device includes: a first control device that continuously stores, into a data storage device, vehicle information indicative of a state of a vehicle having an engine; a first determination device that determines whether the engine is stalled; a second control device that stores engine stall information into the storage unit when the first determination device determines that the engine is stalled while the first control device is storing the vehicle information into the data storage device; and a second determination device that determines whether the engine starts. When the second determination device determines that the engine starts, and the engine stall information is stored in the storage unit, the first control device starts storing the vehicle information into the data storage device.

4 Claims, 3 Drawing Sheets

(51) Int. Cl.
*F02D 41/06* (2006.01)
*G07C 5/08* (2006.01)
*F02N 11/08* (2006.01)

(52) U.S. Cl.
CPC ..... *F02N 11/0848* (2013.01); *F02D 41/065* (2013.01); *F02N 2250/06* (2013.01)

(56) References Cited

U.S. PATENT DOCUMENTS

| | | | | |
|---|---|---|---|---|
| 2003/0051538 | A1 | 3/2003 | Hashiguchi | |
| 2010/0191404 | A1* | 7/2010 | Ishikawa ..... | B60K 35/00 701/31.4 |

FOREIGN PATENT DOCUMENTS

| | | | |
|---|---|---|---|
| JP | H05104985 | A | 4/1993 |
| JP | 200365144 | A | 3/2003 |

* cited by examiner

VEHICLE INFORMATION RECORDING DEVICE, PROGRAM THEREFOR, VEHICLE INFORMATION RECORDING METHOD, AND NON-TRANSITORY COMPUTER-READABLE STORAGE MEDIUM

CROSS REFERENCE TO RELATED APPLICATIONS

This application is a U.S. National Phase Application under 35 U.S.C. 371 of International Application No. PCT/JP2015/000462 filed on Feb. 3, 2015 and published in Japanese as WO 2015/122147 A1 on Aug. 20, 2015. This application is based on and claims the benefit of priority from Japanese Patent Application No. 2014-026613 filed on Feb. 14, 2014. The entire disclosures of all of the above applications are incorporated herein by reference.

TECHNICAL FIELD

The present disclosure relates to a vehicle information recording device that store, into a storage device, vehicle information indicating a travelling state of a vehicle, a program for the vehicle information recording device, a vehicle information recording method, and a non-transitory computer-readable storage medium for the vehicle information recording method.

BACKGROUND ART

There has been a vehicle information recording device that stores, into a nonvolatile memory, vehicle information indicating a traveling state of a vehicle. For example, there has been proposed a data recording device for automobile that records an engine speed, an accelerator position, and the like into an EEPROM at timing decided by combination of at least two of a vehicle velocity, the engine speed, and on/off of an ignition switch (see Patent Literature 1). This data recording device for automobile records data for 10 seconds after the vehicle velocity has become 0 km/h.

The conventional vehicle information recording device stops the vehicle information recording when an engine stall occurs. This is because, for example, when the driver operates an ignition key to activate a starter motor so as to restart the engine, an accessory power supply that supplies power to the device is turned off, or there is performed control to stop the recording after a lapse of a predetermined time as described in Patent Literature 1.

In order to resume the vehicle information recording at the time of restarting the engine, the driver is required to operate a switch for starting the recording, or the like. Further, there is a risk that the driver forgets to perform the switch operation and the data cannot be acquired.

PRIOR ART LITERATURES

Patent Literature

Patent Literature 1: JP-H5-104985-A

SUMMARY OF INVENTION

It is an object of the present disclosure to provide a vehicle information recording device that can easily start vehicle information recording, a program for the vehicle information recording device, a vehicle information recording method, and a persistent computer-readable storage medium for the vehicle information recording method.

According to a first aspect of the present disclosure, a vehicle information recording device includes: a first control device that continuously stores, into a data storage device, vehicle information indicative of a state of a vehicle having an engine as a traveling drive source; a first determination device that determines whether the engine is stalled; a second control device that stores engine stall information into the storage unit when the first determination device determines that the engine is stalled while the first control device is storing the vehicle information into the data storage device; and a second determination device that determines whether the engine starts. When the second determination device determines that the engine starts, and the engine stall information is stored in the storage unit, the first control device starts storing the vehicle information into the data storage device.

In the vehicle information recording device as thus configured, even when the vehicle information recording is suspended due to an engine stall during the recording, the recording is resumed in accordance with the start of the engine. This eliminates the need for operation by the driver to start the recording after the engine start, thereby allowing the vehicle information recording to be easily resumed.

According to a second aspect of the present disclosure, a program functions a computer as each device of the vehicle information recording device according to the first aspect.

While each means constituting the vehicle information recording device of the first aspect may be realized by hardware, it may also be realized by a program for causing a computer to function as each means of the vehicle information recording device as in the second aspect. With such a program, it is possible to cause the computer to function as the vehicle information recording device of the first aspect.

According to a third aspect of the present disclosure, a vehicle information recording method includes: continuously storing, into a data storage device, vehicle information that indicates a state of a vehicle having an engine as a traveling drive source; determining whether the engine is stalled; storing engine stall information into the storage unit when the engine is determined to be stalled while storing the vehicle information into the data storage device; determining whether the engine starts; and starting storing the vehicle information into the data storage device when the engine is determined to start and the engine stall information is stored in the storage unit.

In the above vehicle information recording method, even when the vehicle information recording is suspended due to an engine stall during the recording, the recording is resumed in accordance with the engine start. This eliminates the need for operation by the driver to start the recording after the engine start, thereby allowing the vehicle information recording to be easily resumed.

According to a fourth aspect of the present disclosure, a non-transitory computer-readable storage medium includes: an instruction that is executed by a computer. The instruction includes the vehicle information recording method according to the third aspect.

In the above storage medium, even when the vehicle information recording is suspended due to an engine stall during the recording, the recording is resumed in accordance with the engine start. This eliminates the need for operation by the driver to start the recording after the engine start, thereby allowing the vehicle information recording to be easily resumed.

BRIEF DESCRIPTION OF DRAWINGS

The above and other objects, features and advantages of the present disclosure will become more apparent from the following detailed description made with reference to the accompanying drawings. In the drawings.

EMBODIMENTS FOR CARRYING OUT INVENTION

Hereinafter, an embodiment of the present disclosure will be described along with the drawings.

Embodiment (1) Overall Configuration

Figure 1:
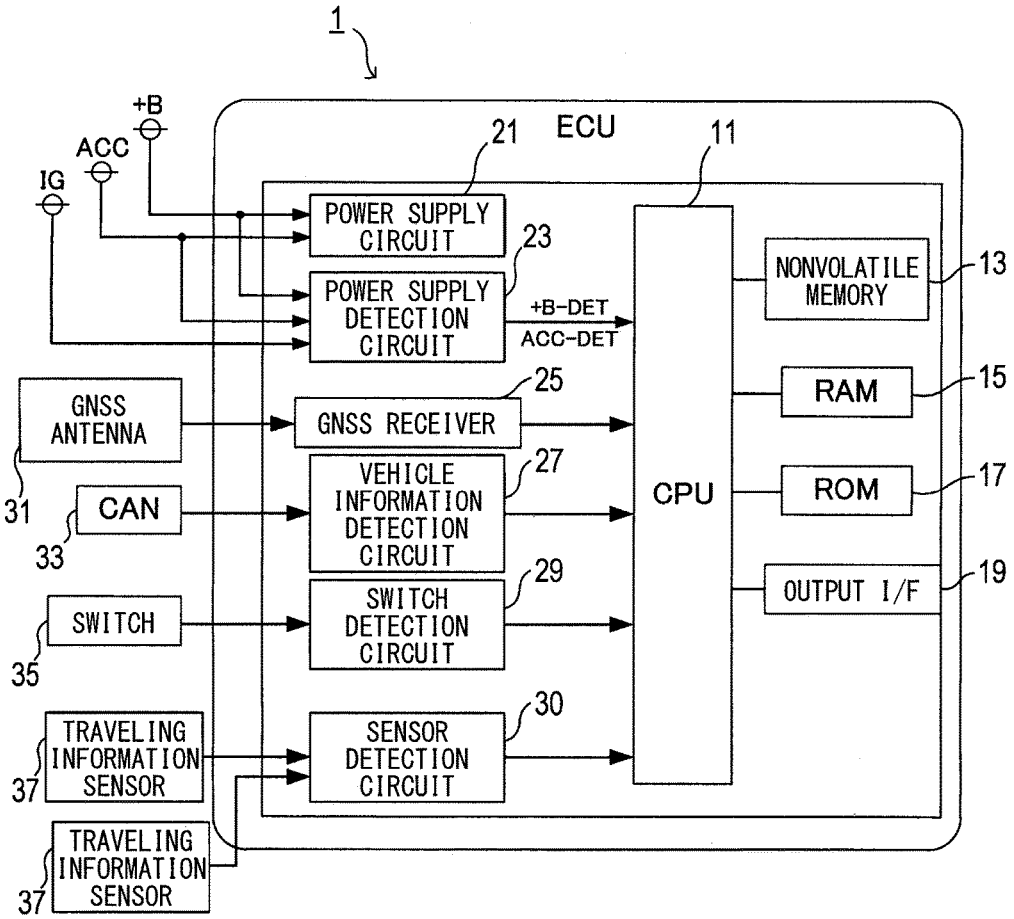
FIG. 1 is a block diagram showing a schematic configuration of a vehicle information recording device.

As shown in FIG. 1, a vehicle information recording device 1 (hereinafter referred to as an ECU 1) of the present embodiment is a device that is used as mounted in a vehicle including an engine as a traveling drive source, and records vehicle information that is data indicating information of the vehicle.

The vehicle information corresponds, for example, to data indicating information of an engine (E/G) speed, a vehicle velocity, an acceleration rate, an angular rate, and a steering angle, data indicating GNSS information (position information), and the like.

The ECU 1 includes a CPU 11, a nonvolatile memory 13, a RAM 15, a ROM 17, an output interface (I/F) 19, a power supply circuit 21, a power supply detection circuit 23, a GNSS receiver 25, a vehicle information detection circuit 27, a switch detection circuit 29, and a sensor detection circuit 30.

The CPU 11 performs integrated control of the ECU 1 in accordance with a program stored in the ROM 17 or the like. This CPU 11 is one example of the first control device, the first determination device, the second control device, and the second determination device in the present disclosure.

The nonvolatile memory 13 is a memory that can hold data even without being supplied with power from a power supply. A memory controller, not shown, receives a command of the CPU 11 and has vehicle information stored thereinto. Typical examples of the nonvolatile memory include a flash memory, an EEPROM, and the like. Other than the vehicle information, engine stall information is stored into the nonvolatile memory 13. The nonvolatile memory 13 is one example of the data storage device and the storage unit in the present disclosure.

Here, the storage unit is a device capable of storing the engine stall information. The data storage device may be used as the storage unit, or a device or a part different from the data storage device may be used as the storage unit.

The engine stall information is data that includes time information and a flag indicating the occurrence of an engine stall in the vehicle during vehicle information recording. Note that the engine stall is a phenomenon that the engine stops regardless of the driver's intention.

The output interface 19 is an interface for connecting with an external device when the vehicle information stored in the nonvolatile memory 13 is to be outputted to the external device.

The power supply circuit 21 is a circuit that is connected with a regular power supply (+B) and an accessory power supply (ACC) of the vehicle, and converts input power from the regular power supply and the ACC to necessary power, and the converted output power is supplied to each portion constituting the ECU 1. The primary processing in the ECU 1 is executed when the accessory power supply is on.

The power supply detection circuit 23 is a circuit that is connected with the regular power supply, the accessory power supply, and an ignition power supply (IG), and outputs a power supply state signal indicating an on/off state of each power supply to the CPU 11. Note that the power supplies are outputted from one common battery, and the on/off of the output can be switched by operation of an ignition key. It may be configured such that the signal of the IG is acquired by the vehicle information detection circuit 27 from a CAN 33 described later.

The GNSS (Global Navigation Satellite System) receiver 25 receives a signal outputted from an artificial satellite for GNSS by use of the GNSS antenna 31, and outputs the signal to the CPU 11.

The vehicle information detection circuit 27 is a circuit that is connected to the CAN (Controller Area Network) 33, acquires information indicating the state of the vehicle, the information being outputted from another ECU connected with the CAN 33, and outputs the information to the CPU 11.

The switch detection circuit 29 is a circuit that acquires a signal indicating input operation performed by the driver on a switch 35, and outputs contents of the input operation to the CPU 11. The switch 35 is configured so as to perform on-operation of starting the vehicle information recording and off-operation of stopping the vehicle information recording, and is provided in a position where the switch 35 can be operated by the driver, such as the vicinity of an installment panel.

The sensor detection circuit 30 is a circuit that is connected to a plurality of traveling information sensors 37 and outputs, to the CPU 11, traveling information acquired from the traveling information sensor 37. The traveling information sensor 37 is a sensor that acquires data indicating a traveling state of the vehicle, and corresponds to an acceleration rate sensor or an angular rate sensor as one example, but information on a sensor other than these sensors may be acquired.

The CPU 11 starts the vehicle information recording when the on-operation is performed on the switch 35 with the accessory power supply being on, and the CPU 11 completes the vehicle information recording when the accessory power supply is turned off or the off-operation is performed on the switch 35.

Further, the ECU 1 includes a known real time clock, not shown, and the CPU 11 can acquire information on the current time.

(2) Control by CPU 11

(2-1) Vehicle Information Recording Operation Upon Occurrence of Engine Stall

Figure 2:
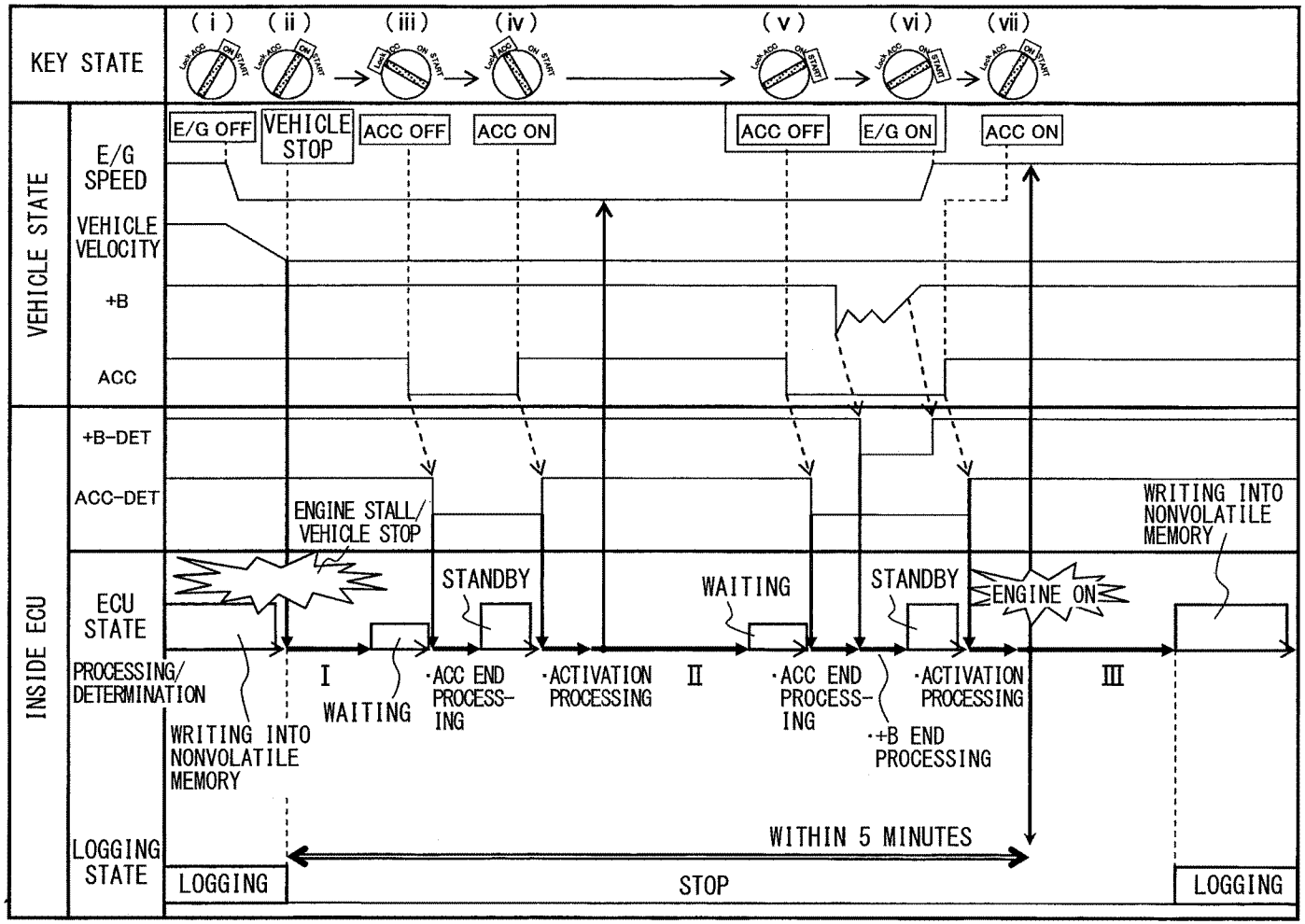
FIG. 2 is a diagram explaining a specific example of vehicle information recording operation.

With reference to FIG. 2, a description will be given of a specific example of vehicle information recording control performed by the ECU 1 of the present embodiment upon the occurrence of an engine stall. FIG. 2 shows in a time-series manner the operation of the ECU 1 in a case where the engine stalls during traveling of the vehicle and the driver starts the engine after a lapse of a predetermined time.

In FIG. 2, I shows that, after confirmation of an engine stall (confirmation of a speed equal to or lower than 200 rpm), confirmation of the stop of the vehicle (confirmation of a vehicle velocity equal to or lower than 10 km/h), and confirmation of the ignition key being on, a file is closed and engine stall information is backed up. In FIG. 2, II shows that, after confirmation of the backup (confirmation of the presence of the engine stall information) and confirmation of the engine speed (confirmation of an engine speed of 0 rpm), logging is unnecessary. In FIG. 2, III shows that, after confirmation of the backup (confirmation of the presence of the engine stall information) and confirmation of the engine speed (confirmation of an engine speed equal to or higher than 500 rpm), confirmation of the time from the backup (confirmation of the time from the backup being within 5 minutes), and confirmation of the ignition key being on, the logging is resumed and the engine stall information is deleted. In FIG. 2, a "key state" shows a switching state of the ignition key (IG key). The IG key is switched by operation of the driver. The IG key is switchable to: a Lock position ((iii) of FIG. 2) at which only the regular power supply is on; an ACC position ((iv) of FIG. 2) at which the regular power supply and the accessory power supply are on; an ON position ((i), (ii), (vii) of FIG. 2) at which all of the regular power supply, the accessory power supply, and the IG power supply are on; and a START position ((v), (vi) of FIG. 2) at which cranking is executed by a starter motor with the regular power supply being on.

Further, a "vehicle state" is information required for the vehicle information recording control by the CPU 11. Specifically, the E/G speed, the vehicle traveling velocity (vehicle velocity), the output state of the regular power supply (+B), and the output state of the accessory power supply (ACC) correspond to the vehicle state.

Further, in "Inside ECU", "+B-DET" and "ACC-DET" are power supply state signals indicating the on/off states of the regular power supply and the accessory power supply. "ECU state" shows a state of operation and processing of the ECU 1, and "processing/determination" shows specific contents of the processing.

"Logging state" shows whether the vehicle information is being written into a data file (whether the logging is being performed). Both the case of the ECU state being "writing into nonvolatile memory" and the case of the logging state being "logging" mean that the vehicle information is being written into the data file.

The operation example of FIG. 2 starts from a state where the IG key is at the position of (i), the vehicle is traveling, and the vehicle information is being recorded. During the logging, the vehicle information is continuously written into the data file on a storage region made up of the nonvolatile memory 13. Note that the continuous writing means that writing processing is executed in a predetermined cycle or at short time intervals.

When the engine stall occurs in this state, the E/G speed decreases. At the same time, the vehicle velocity decreases to 0, and the vehicle stops. The key state remains on as in (ii) until the driver operates the key.

The CPU 11 monitors the E/G speed and the vehicle velocity to confirm the engine stall and the vehicle stop. As shown in "Processing/determination", the occurrence of the engine stall is confirmed when the IG key is on and the E/G speed is equal to or lower than a predetermined threshold (200 rpm in the present embodiment). Further, when the vehicle velocity is equal to or lower than a predetermined threshold (10 km/h in the present embodiment), the vehicle stop is confirmed.

When the engine stall and the vehicle stop are confirmed, the CPU 11 executes closing of the data file under logging, to bring the data into a protected state where it is hardly lost due to a voltage drop of the battery. Further, the CPU 11 backs up the engine stall information into a predetermined storage region of the nonvolatile memory 13. After completion of the file closing and the backup, the ECU 1 comes into a waiting state.

Here, when the driver operates the IG key to the Lock position as (iii), the accessory power supply is turned off, the ACC-DET shifts to a low level, and ACC end processing is executed for safely stopping each function of the ECU 1 and bringing it into a power-saving standby state.

In the standby state, when the driver operates the IG key to the ACC position as (iv), the accessory power supply is turned on, and activation processing is executed for bringing the ECU 1 into an activated state where each function can be executed.

When the ECU 1 comes into the activated state, whether the engine stall information has been backed up is confirmed while the E/G speed is confirmed. The logging is resumed when all of the following conditions are satisfied: the E/G speed is equal to or higher than a predetermined threshold (500 rpm in the present embodiment), the backup of the engine stall information is present; and the elapsed time from the time information included in the engine stall information to the current time is equal to or shorter than a predetermined threshold.

Here, since the E/G speed is equal to or lower than the predetermined threshold while the backup of the engine stall information is present, the logging is not started and the state enters the waiting state.

Subsequently, when the driver switches the IG key to the START position of (v) so as to start the engine, the accessory power supply is turned off, and hence the foregoing ACC end processing is executed. Further, as a result of a voltage drop of the regular power supply due to cranking, the +B-DET temporarily shifts to the low level, and +B end processing is started. When the voltage of the regular power supply then recovers, the state enters the standby state until the accessory power supply is turned on.

When the engine starts and the E/G speed increases, the driver returns the IG key from the START position of (vi) to the ON position of (vii). As a result, the accessory power supply is turned on, and the ECU 1 executes the foregoing activation processing.

When the ECU 1 comes into the activated state, whether the engine stall information has been backed up is confirmed while the E/G speed is confirmed. Here, the backup of the engine stall information is present, and the E/G speed is beyond the predetermined threshold. Further, since the elapsed time from the time information included in the engine stall information to the current time is equal to or shorter than a predetermined threshold (5 minutes in the present embodiment), the backed-up engine stall information is deleted and the logging is resumed.

(2-2) Vehicle Information Recording Processing

The vehicle information recording processing executed by the CPU 11 of the ECU 1 will be described with reference to a flowchart of FIG. 3. The present processing starts when the ECU 1 is supplied with power of the accessory power supply and comes into the activated state.

In the present processing, first in S1, it is determined whether the engine stall information has been backed up. When the engine stall information has not been backed up (S1: NO), the processing moves to S2. When the engine stall information has been backed up (S1: YES), the processing moves to S9.

In next S2, it is determined whether a recording start trigger is generated. The recording start trigger is that the on-operation is performed on the switch 35, but a trigger other than that may be used. When the recording start trigger is not generated (S2: NO), S2 is executed again, to wait for the trigger to be generated. When the recording start trigger is generated (S2: YES), the processing moves to S3.

In next S3, the vehicle information recording is started. The CPU 11 creates a data file, into which the vehicle information is to be written, on the storage region made up of the nonvolatile memory 13. The data file is then opened, and the vehicle information is written into the data file along with the time information at predetermined time intervals (e.g., 100 ms).

After the vehicle information recording is started, it is determined whether a recording end trigger is generated in S4. The recording end trigger is that the off-operation is performed on the switch 35, or that the accessory power supply is turned off, but a trigger other than those may be used. When the recording end trigger is generated (S4: YES), the processing moves to S5. On the other hand, when the recording end trigger is not generated (S4: NO), the processing moves to S6.

In next S5, the file is closed. Here, the operation to write the vehicle information into the data file is completed, to bring the data file into the protected state. Thereafter, the processing returns to S2.

Further, in S6, it is determined whether the state is the engine stall state as well as the vehicle stop state. Here, the state is determined to be the engine stall state when the ignition power supply is on (the IG key is at the on-position) and the E/G speed is equal to or lower than the predetermined threshold (200 rpm). Further, the state is determined to be the vehicle stop state when the vehicle velocity is equal to or lower than the predetermined threshold (10 km/h). When all these conditions are satisfied, the state is determined to be the engine stall state as well as the vehicle stop state.

When the state is not determined to be the engine stall state as well as the vehicle stop state (S6: NO), the processing returns to S4. On the other hand, when the state is determined to be the engine stall state as well as the vehicle stop state (S6: YES), the data file, where the vehicle information writing has been executed, is closed in S7 as in S5 described above.

In next S8, the engine stall information concerning the engine stall determined in S6 is backed up into the nonvolatile memory 13. The time information included in the engine stall information can be taken, for example, as a time at which the state is determined to be the engine stall state as well as the vehicle stop state in S6. After this S8, the present processing is completed.

Note that the time recorded as the time information may only be predetermined timing caused by the occurrence of the engine stall, and is not restricted to the timing of the determination in S6 above. For example, the time at which the state is determined to be the engine stall state may be recorded as the time information, or the time at which the backup is performed in S8 may be recorded as the time information.

Further, in S9, it is determined whether the E/G speed is equal to or higher than the predetermined threshold (500 rpm). When the E/G speed is lower than the predetermined threshold (S9: NO), the present processing is completed. On the other hand, when the E/G speed is equal to or higher than the predetermined threshold (S9: YES), the processing moves to S10.

In next S10, it is determined whether the elapsed time from the execution of the backup in S8 to the current time is within the predetermined time (5 minutes). Here, the elapsed time is calculated by comparison of the time information included in the engine stall information and the current time. When the elapsed time is within the predetermined time (S10: YES), the vehicle information recording is started in S11 as in S3 described above, and the backed-up engine stall information is deleted in S12. Thereafter, the processing moves to S4.

On the other hand, when the elapsed time is not within the predetermined time (S10: NO), the backed-up engine stall information is deleted in S13 without starting the vehicle information recording. Thereafter, the processing returns to S2.

(3) Effects

The CPU 11 of the ECU 1 of the present embodiment executes the processing of: storing into the nonvolatile memory 13 vehicle information that indicates the state of the vehicle provided with the engine as the traveling drive source (S3, S11); determining whether the engine has stalled (S6); determining whether the engine has started (S9); and storing the engine stall information into the nonvolatile memory 13 when the engine is determined to have stalled during storing the vehicle information into the nonvolatile memory 13 (S8).

When the engine is determined to have started (S9: YES) and the engine stall information is stored in the nonvolatile memory 13 (S1: YES), the CPU 11 starts storing the vehicle information into the nonvolatile memory 13 (S11).

The ECU 1 as thus configured resumes the vehicle information recording in accordance with the engine start even when the recording is suspended due to the engine stall during the recording. Therefore, when the vehicle information is to be continuously recorded after the engine start, the driver is not required to perform operation for starting the recording after the engine start, thus allowing the vehicle information recording to be easily resumed.

Further, the vehicle information recording is not resumed only by turning-on of the accessory power supply and activation of the ECU 1, and the engine start is the condition for resuming the recording. Hence it is possible to prevent recording of the vehicle information before the engine start, and thereby to suppress reduction in energy consumption and deterioration due to the use of the nonvolatile memory 13.

Although the configuration of suspending the vehicle information recording at the time of determining the engine stall is illustrated in the present embodiment, the present disclosure can be applied without being restricted to this configuration. This is because, for example, when the IG key is switched to the START position when the engine is to be restarted after the engine stall, the accessory power supply may be turned off or the voltage drop of the regular power supply may be generated to cause the function of the device to stop, thus suspending the vehicle information recording.

Further, the CPU 11 starts storing the vehicle information into the nonvolatile memory 13 when the engine is determined to have started, the engine stall information is stored in the nonvolatile memory 13, and the time from the engine stall to the engine start is equal to or shorter than the predetermined threshold (S10: YES).

When the time from the engine stall to the engine restart is long, it is highly possible that a trouble has occurred as in a case where a vehicle comes into contact with an obstacle and is broken down, for example, In such a case, there is a low need for resuming the vehicle information recording accompanied by the engine restart. The ECU 1 of the present embodiment does not resume the vehicle information recording when the time from the engine stall to the engine restart is long, thereby enabling prevention of the vehicle information recording when unnecessary.

Further, in the present embodiment, the engine stall information includes the time information, and the CPU 11 measures the time from the engine stall to the engine start on the basis of the time information and the current time (S10). Hence it is possible to easily measure the time.

Note that the timing of the engine stall, which is taken as the start of the foregoing time measurement, may only be predetermined timing due to the occurrence of the engine stall. For example, it is possible to consider that the timing at which the E/G speed is 0, the timing at which the E/G speed falls below the predetermined threshold, the timing at which the engine stall information is recorded into the nonvolatile memory, or the like, is taken as the timing of the engine stall.

Further, the ECU 1 of the present embodiment is assumed to be in a state where the data file that is under writing at the time of the engine stall has been rapidly closed. Hence, even when the battery voltage temporarily abruptly drops due to cranking after the engine stall, the possibility that the data file is in the open state at that timing has been reduced, to suppress a loss of the data file, thus enabling more reliable vehicle information recording.

Other Embodiments

Although the embodiment of the present disclosure has been described above, needless to say, the present disclosure is not restricted to the above embodiment, and can take a variety of forms so long as belonging to the technical scope of the present disclosure.

For example, in the above embodiment, the configuration has been illustrated where the data, which includes the time information and the flag indicating the engine stall, is recorded into the nonvolatile memory 13 as the engine stall information. However, the data can be other than this data so long as being data that enables confirmation of the occurrence of the engine stall.

Note that the engine stall information is not required to be recorded as one data, but for example, it may be configured to be recorded as another data obtained by associating data of the flag indicating the engine stall with data indicating the time information.

Further, in the above embodiment, the configuration has been illustrated where the engine is determined to have stalled when the ignition power supply is on and the E/G speed is equal to or lower than the predetermined threshold. However, a variety of engine stall determination methods other than this method can be employed.

Moreover, in the above embodiment, the configuration has been illustrated where the time information recorded as the engine stall information and the current time are compared so as to measure the time from the engine stall to the engine start. However, the above time can be measured by another method. For example, the configuration may include a timer for counting the time from determination of the state as the engine stall state.

Further, in the above embodiment, the configuration has been illustrated where the CPU 11 functions as the first determination device, the second determination device, the first control device, and the second control device in the present disclosure. However, it may be configured such that the respective devices may function by different CPUs, chips, integrated circuits, and the like.

Figure 3:
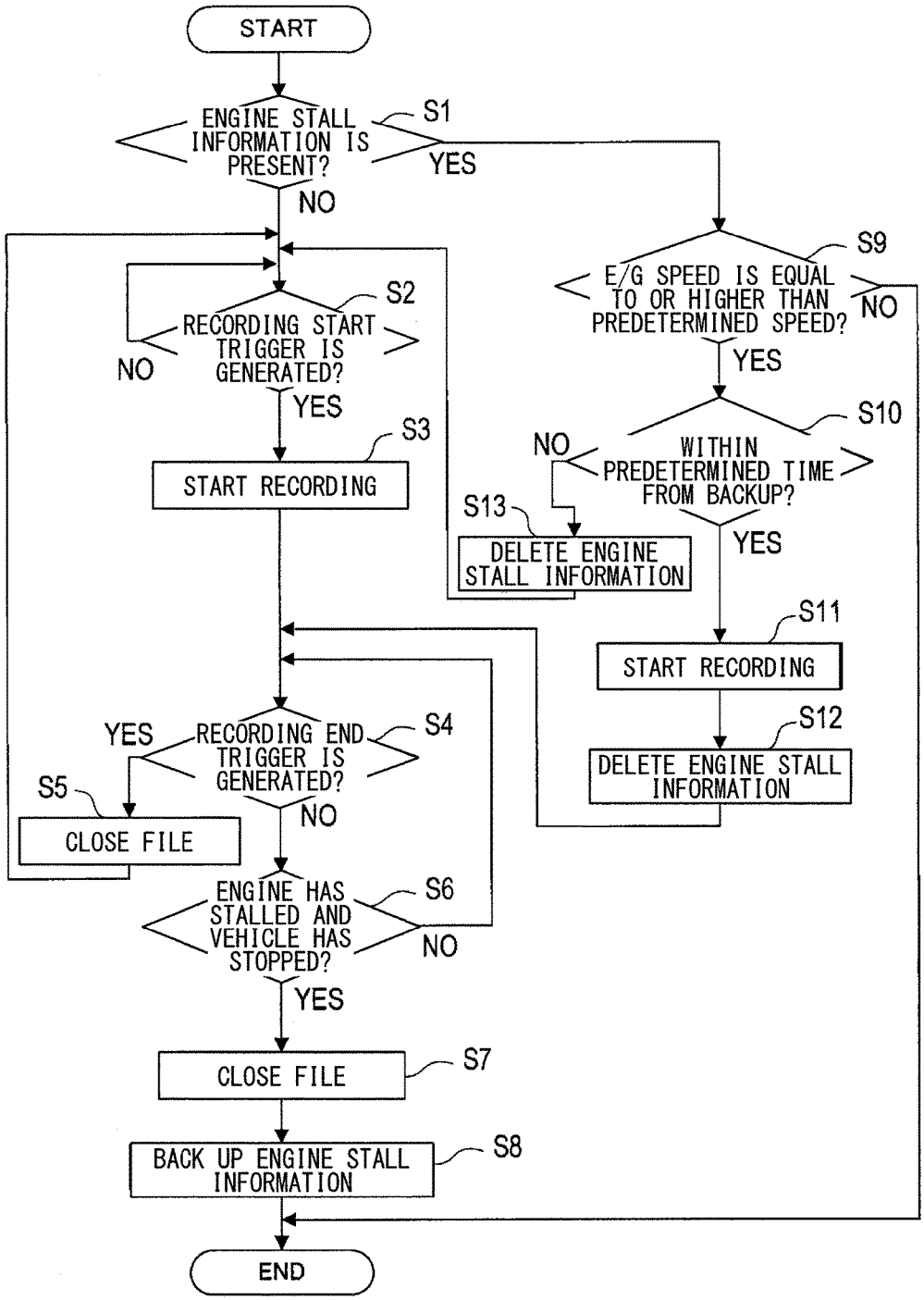
FIG. 3 is a flowchart showing a processing procedure for vehicle information recording processing.

Moreover, in the above embodiment, the configuration has been illustrated where the vehicle information recording is resumed when the elapsed time from execution of the backup of the engine stall information to the current time is equal to or shorter than the predetermined time in S10 of FIG. 3. However, it may be configured such that the above elapsed time is not considered and the vehicle information recording is resumed upon the engine start while the engine stall information is being stored.

Furthermore, in the above embodiment, the configuration has been illustrated where the vehicle information and the engine stall information are recorded into the nonvolatile memory 13. However, it may be configured such that these are stored into a different recording device. However, either information is desirably recorded into a recording device capable of holding data even without being supplied with power, such as a nonvolatile memory or a hard disk.

Note that each function provided in the foregoing ECU 1 can be realized by the computer by use of a program.

The program may be made up of columns of ordered commands suitable for processing by the computer. The program may be used by being stored into a ROM or a RAM incorporated in the computer and loaded to the computer from a ROM or a RAM, or may be used by being loaded to the computer via a variety of recording mediums and communication lines.

Examples of the recording medium include optical disks such as a CD-ROM and a DVD-ROM, a magnetic disks, semiconductor memories, and the like.

It is noted that a flowchart or the processing of the flowchart in the present application includes sections (also referred to as steps), each of which is represented, for instance, as S1. Further, each section can be divided into several sub-sections while several sections can be combined into a single section. Furthermore, each of thus configured sections can be also referred to as a device, module, or means.

While the present disclosure has been described with reference to embodiments thereof, it is to be understood that the disclosure is not limited to the embodiments and constructions. The present disclosure is intended to cover various modification and equivalent arrangements. In addition, while the various combinations and configurations, other combinations and configurations, including more, less or only a single element, are also within the spirit and scope of the present disclosure.

The invention claimed is:

1. A vehicle information recording device comprising:

a first control device that stores, into a non-transitory data storage device, vehicle information indicative of a state of a vehicle having an engine as a traveling drive source;

a first determination device that determines whether the engine is stalled;

a traveling information sensor that determines whether the vehicle is stopped;

a second control device that stores engine stall information into a non-transitory storage unit when the first determination device determines that the engine is stalled and the traveling information sensor determines that the vehicle is stopped while the first control device is storing the vehicle information into the non-transitory data storage device; and a second determination device that determines whether the engine starts, wherein:

when the second determination device determines that the engine starts, and the engine stall information is stored in the non-transitory storage unit, the first control device starts storing the vehicle information into the non-transitory data storage device when (i) the second determination device determines that the engine starts, (ii) the engine stall information is recorded in the non-transitory storage unit, and (iii) a time from an engine stall to an engine start is equal to or shorter than a predetermined threshold;

the vehicle information indicates a travelling state of the vehicle and a part of the vehicle information is used for at least an operation of an engine of the vehicle; and the engine stall information includes time information and a flag indicating an occurrence of an engine stall.

2. The vehicle information recording device according to claim 1, wherein:

the engine stall information includes time information; and the first control device measures the time from the engine stall to the engine start based on the time information and the current time.

3. A vehicle information recording method comprising:

storing, via a first control device, into a non-transitory data storage device, vehicle information that indicates a state of a vehicle having an engine as a traveling drive source;

determining, via a first determination device, whether the engine is stalled;

a traveling information sensor that determines whether the vehicle is stopped;

storing, via a second control device, engine stall information into a non-transitory storage unit when the engine is determined to be stalled and the traveling information sensor determines that the vehicle is stopped while storing the vehicle information into the non-transitory data storage device;

determining, via a second determination device, whether the engine starts; and starting storing, via the first control device, the vehicle information into the non-transitory data storage device and deleting the engine stall information when tithe engine is determined to start and the engine stall information is stored in the non-transitory storage unit (ii) the second determination device determines that the engine starts, (iii) the engine stall information is recorded in the non-transitory storage unit, and (iv) a time from an engine stall to an engine start is equal to or shorter than a predetermined threshold;

wherein:

the vehicle information indicates a travelling state of the vehicle and a part of the vehicle information is used for at least an operation of an engine of the vehicle; and the engine stall information includes time information and a flag indicating an occurrence of an engine stall.

4. A non-transitory computer-readable storage medium comprising:

an instruction that is executed by a computer, comprising:

storing, via a first control device, into a non-transitory data storage device, vehicle information that indicates a state of a vehicle having an engine as a traveling drive source;

determining, via a first determination device, whether the engine is stalled;

a traveling information sensor that determines whether the vehicle is stopped;

storing, via a second control device, engine stall information into a non-transitory storage unit when the engine is determined to be stalled and the traveling information sensor determines that the vehicle is stopped while storing the vehicle information into the non-transitory data storage device;

determining, via a second determination device, whether the engine starts; and starting storing, via the first control device, the vehicle information into the non-transitory data storage device and deleting the engine stall information when (i) the engine is determined to start and the engine stall information is stored in the non-transitory storage unit (ii) the second determination device determines that the engine starts, (iii) the engine stall information is recorded in the non-transitory storage unit, and (iv) a time from an engine stall to an engine start is equal to or shorter than a predetermined threshold;

wherein:

the vehicle information indicates a travelling state of the vehicle and a part of the vehicle information is used for at least an operation of an engine of the vehicle; and the engine stall information includes time information and a flag indicating an occurrence of an engine stall.

* * * * *